US006354644B1

(12) United States Patent
Zaguroli, Jr. et al.

(10) Patent No.: US 6,354,644 B1
(45) Date of Patent: Mar. 12, 2002

(54) APPARATUS FOR HANDLING HOLLOW CORE ROLLS

(76) Inventors: James Zaguroli, Jr., 3030 Loon Lake Shores, Drayton Plains, MI (US) 48020; Steven R. Sowter, 13971 Diversion, Sterling Heights, MI (US) 48313

( * ) Notice: Subject to any disclaimer, the term of this patent is extended or adjusted under 35 U.S.C. 154(b) by 0 days.

(21) Appl. No.: 09/556,356

(22) Filed: Apr. 24, 2000

Related U.S. Application Data

(60) Provisional application No. 60/130,715, filed on Apr. 22, 1999.

(51) Int. Cl.[7] ..... B66C 1/54

(52) U.S. Cl. ..... 294/67.22; 294/67.5; 294/86.41; 294/93; 294/96

(58) Field of Search ..... 294/67.2–67.22, 294/67.5, 81.4, 82.28, 86.1, 86.12, 86.24, 86.25, 86.41, 88, 93–98.1, 103.2; 279/2.01, 2.06–2.09, 2.1–2.13; 414/607, 626, 659, 663, 684, 783, 910, 911

(56) References Cited

U.S. PATENT DOCUMENTS 1,524,265 A * 1/1925 Lester ..... 294/86.24
2,787,492 A * 4/1957 Gisser et al. ..... 294/96
2,925,300 A * 2/1960 Kelley ..... 294/67.22 X
4,154,470 A * 5/1979 Dalglish ..... 294/93
4,253,694 A * 3/1981 Walter et al. ..... 294/98.1
4,358,143 A * 11/1982 Cullen ..... 294/93 X
4,557,515 A * 12/1985 Read ..... 294/67.22
4,708,574 A * 11/1987 Conboy et al. ..... 294/67.5 X
4,955,655 A * 9/1990 Caracciolo et al. ..... 294/93
6,116,669 A * 9/2000 Scaglia ..... 294/67.22

* cited by examiner

*Primary Examiner*—Johnny D. Cherry
(74) *Attorney, Agent, or Firm*—John R. Benefiel

(57) ABSTRACT

Apparatus for handling hollow core rolls of different core diameters, by picking up a roll disposed with its axis vertical, relating the same to a horizontal position, and sliding it onto a horizontally extending spindle. A stepped diameter holder having sets of gripper elements is supported on an angled arm driven by a rotary actuator. After insertion of the stepped diameter into a roll core and outward movement of the gripper elements, the core can be moved to a horizontal orientation by oscillation of the actuator. The stepped diameter holder has a ball locking assembly which is inserted into a receptacle attached to the projecting end of the spindle. After full insertion sensed by blockage of air flow out of a hole in the end of an actuator rod caused by contact with a compressible insert, the actuator rod is moved axially to dock the spindle to the stepped holder by operation of the ball locking assembly and the gripper elements are released, allowing powered push off of the roll onto the spindle.

7 Claims, 3 Drawing Sheets

APPARATUS FOR HANDLING HOLLOW CORE ROLLS

CROSS REFERENCE TO RELATED APPLICATION

This application claims the benefit of provisional patent application, Ser. No. 60/130,715, filed Apr. 22, 1999.

BACKGROUND OF THE INVENTION

This invention concerns roll handling apparatus for hollow core rolls of a type disclosed in U.S. Pat. Nos. 4,708,574; 5,468,116; and 4,226,567.

In such apparatus, an internal gripper is inserted in the roll hollow core and gripper elements are expanded to engage the core. The roll can then be lifted by a hoist, and reoriented by a manual adjustment of an angled support arm.

Such apparatus is often used to load heavy rolls onto spindles of textile equipment or other similar machines. It has heretofore been considered desirable to have a "docking" feature, in which the gripper is coupled to a receiving spindle prior to pushing the roll onto the spindle with a pusher cylinder.

The docking feature insures that the spindle and roll core are held together properly aligned and to prevent separation of the spindle and a roll holder when the roll is pushed onto the spindle.

In such prior art devices, the gripper has been comprised of a stepped diameter holder "nose", adapted to be used with two different inside diameter roll cores, i.e., a three inch and six inch inside diameter core, each stepped diameter having a set of expanding fingers pushed out by axial movement of an actuator rod stroked by an air cylinder to grip the core.

The docking feature as previously practiced involved operating the three inch fingers to grip a spindle receptacle, when six inch rolls were being handled. This precluded "docking" when only six inch core rolls were being handled.

In U.S. Pat. No. 4,708,574, the orientation of a roll has been carried out with an arm having an angled joint, the roll manually rotated about the joint to be reoriented. Powered reorientation using robots or complex and bulky linkages and power cylinders has been practiced.

It is also desirable to insure that docking and loading has been successfully completed during the process without relying solely on careful observations by an operator.

Accordingly, it is the object of the present invention to provide apparatus for handling rolls of the type described which allows docking with both size roll cores with stepped diameters.

It is a further object to provide an arrangement for insuring that docking and loading has taken place prior to releasing a gripped roll for transfer onto a spindle.

It is a still further object to make handling to reorient the rolls quicker and easier then with the manual methods previously practiced, without requiring bulky or complex equipment.

SUMMARY OF THE INVENTION

The above objects as well as others which will be understood upon a reading of the following specification and claims are accomplished by adding a locking ball assembly of smaller diameter than the smaller diameter of a stepped diameter holder for receiving roll cores to be handled, the ball locking assembly projecting from the end of the smallest diameter of the holder.

An actuator rod and air cylinder is used to spread and retract two sets of gripper elements by axial motion of the rod, each set actuated by the rod, which also passes within the ball sleeve assembly. When the stepped diameter holder is maneuvered towards the spindle, the actuator rod end is inserted into a receptacle fixed to the end of the spindle. A compressible insert is contacted when the rod end is fully inserted, blocking air flow out of an internal passage through the end of the rod. The resulting increase in pressure in the passage enables activation of the air cylinder to retract the rod, which releases the gripper elements and also forces the locking balls outwardly to engage the receptacle bore wall. Retraction of grippers releases the roll on the holder to allow the roll to be pushed onto the spindle with a pusher cylinder. Either diameter of the stepped holder may use these docking features.

An angled arm supports the stepped diameter holder, and a rotary actuator has an output shaft extending at the same angle and enables powered rotation of the angled arm to reorient a roll held on the stepped diameter holder.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
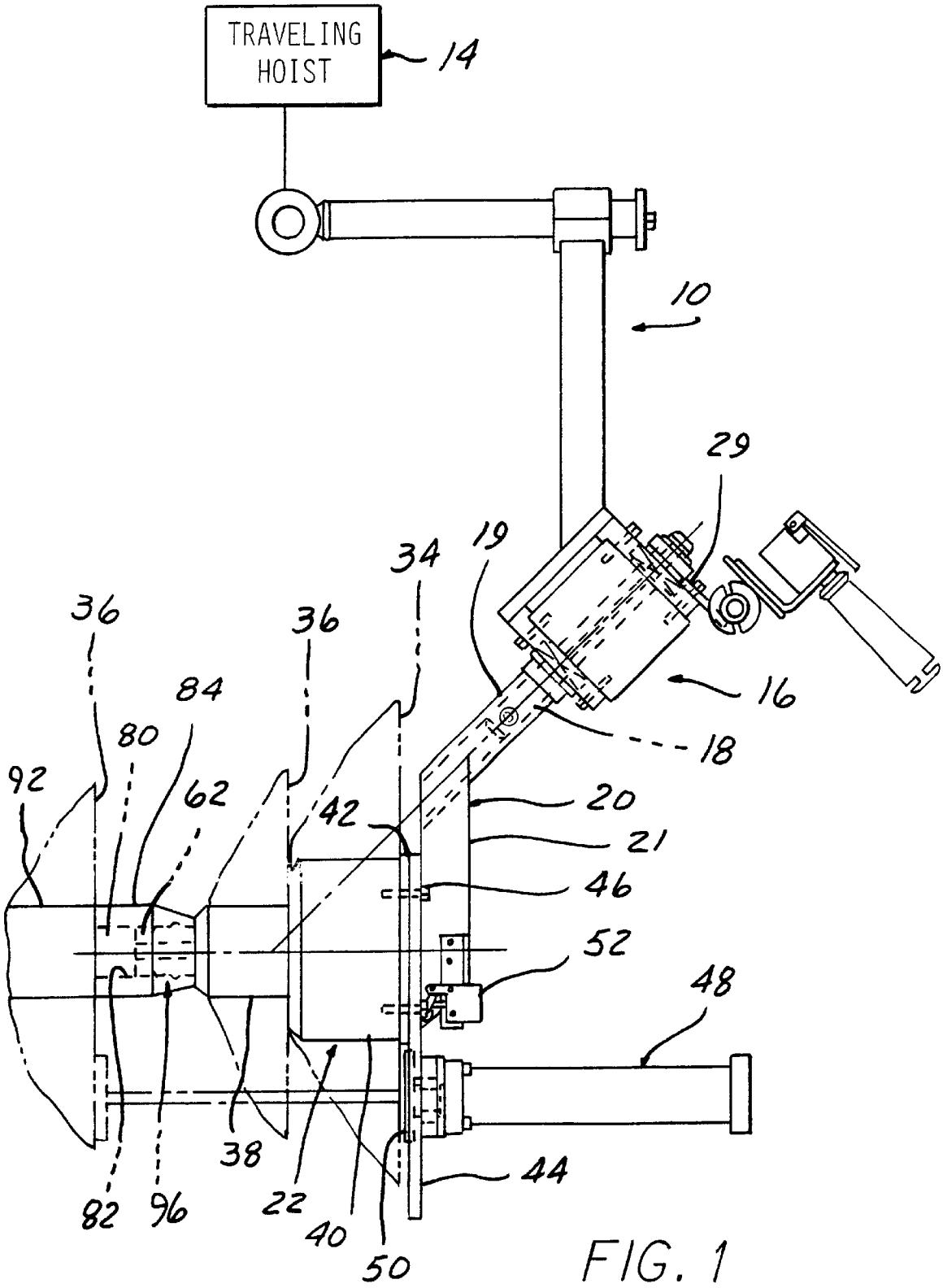
FIG. 1 is a side view of the roll handling apparatus according to the invention with an adjacent spindle and receptacle, rolls shown in phantom lines outline.

Referring to FIG. 1, the apparatus 10 includes an upper frame, which may be supported on a traveling hoist 14 which may be of a well known air balancing type.

A rotary actuator 16 has an angled output shaft 18 extending at an angle inclined from the vertical, connected to an angled arm 20.

The arm 20 has an upper portion 19 connected to the shaft 18 and an angled lower portion 21.

A stepped diameter roll holder 22 is mounted to the lower portion 21 of the angled arm 20, projecting perpendicularly therefrom.

Figure 2:
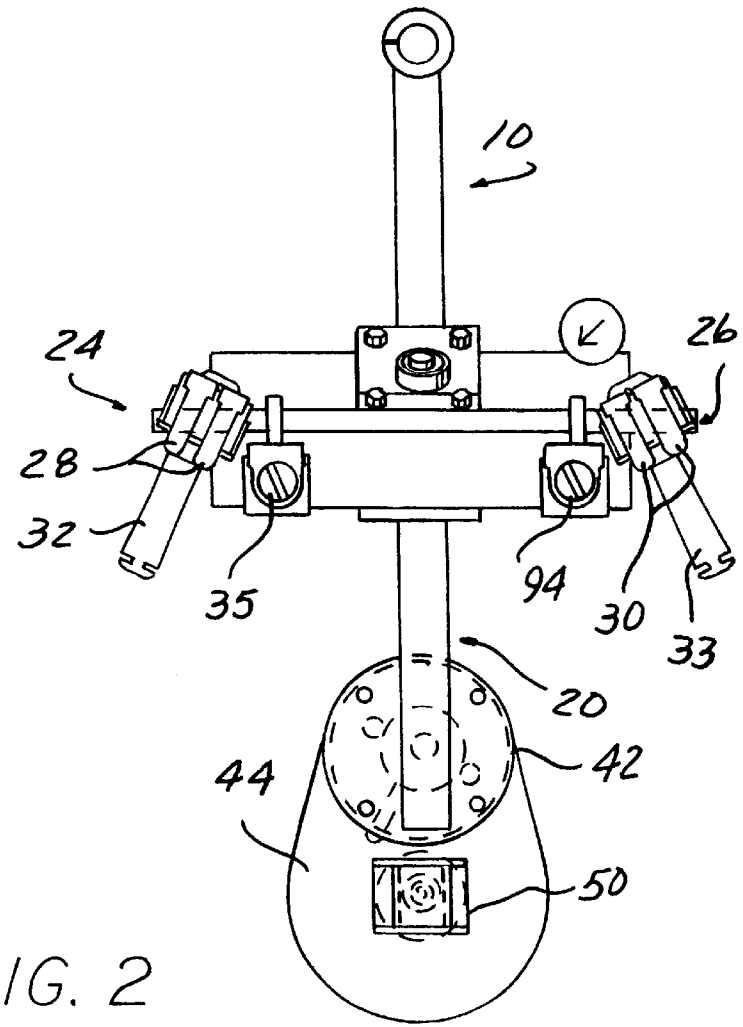
FIG. 2 is an end view of the apparatus shown in FIG. 1.
Figures 3, 5:
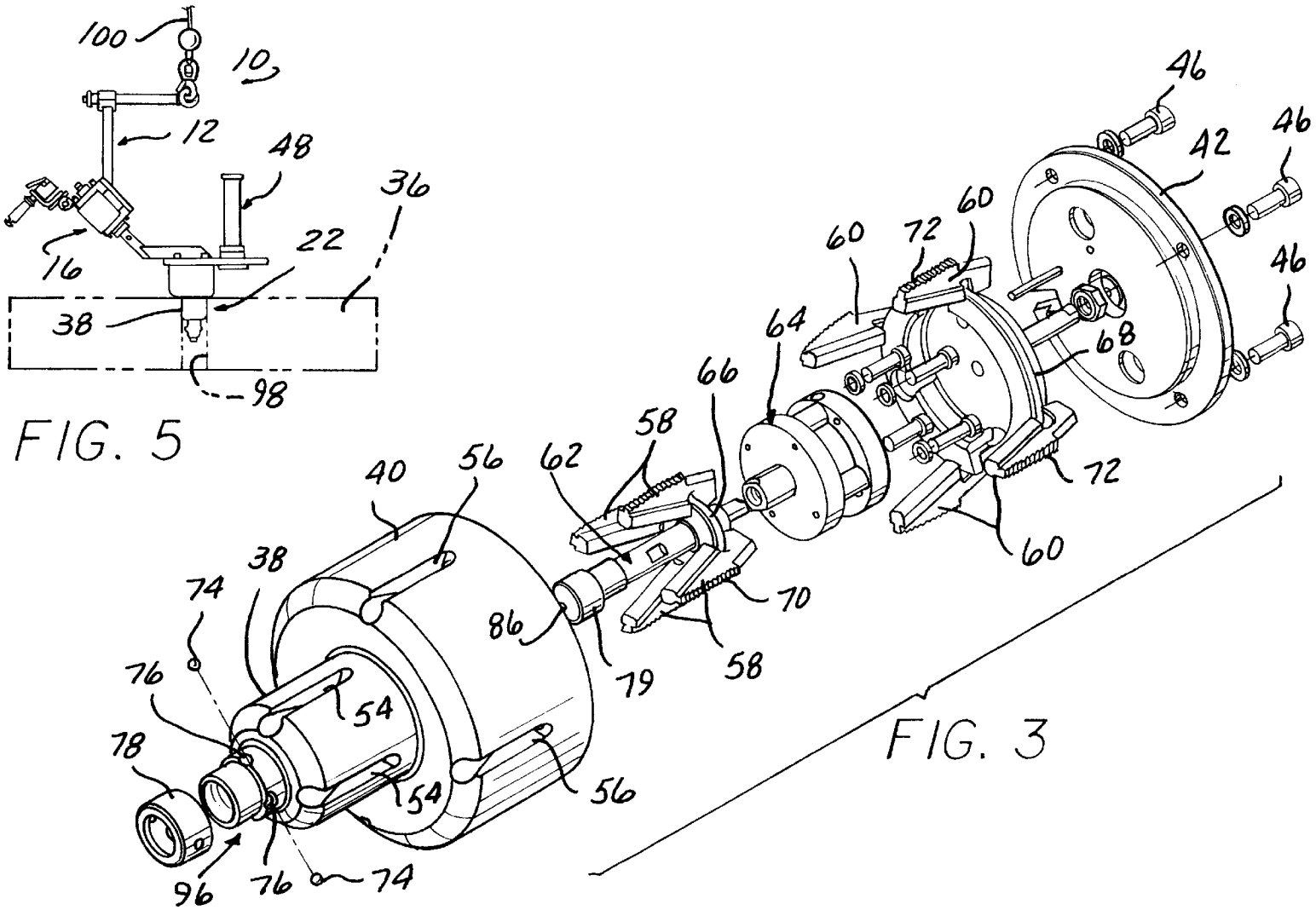
FIG. 3 is an exploded perspective view of a stepped diameter holder, showing the internal operating components.
FIG. 5 is a reduced size view of the roll handling apparatus shown reoriented to pick up a roll shown in phantom lines lying horizontally.

The rotary actuator 16 comprises a special air cylinder causing 180° oscillation of the output shaft 18. A suitable oscillator is model #D-1000 sold by Ohio Oscillator. The angled arm 20 is flipped between two orientations by operation of the rotary actuator 16. That is, the lower portion 21 extends vertically in one position (FIG. 1) or horizontally is another position (FIG. 5). This causes the stepped holder 22 to be oriented either horizontally (FIG. 1) or vertically (FIG. 5), so that a gripped roll 34, 36 may be reoriented. The actuator 16 mounts controls attached by a bracket 29, 24, 26, each having associated pairs of push levers 28, 30 (FIG. 2) for controlling the movement of the hoist 14 and the unclamping and push off of the rolls as described below. Handles 32, 33 are used by the operator to maneuver a large or small core diameter roll 34 or 36 clamped on the stepped diameter nose 22.

Powered rotation of the arm 20 will reorient a gripped roll 34 or 36 from a vertical to a horizontal orientation. FIG. 5 shows a vertically oriented roll gripped on the holder. A knob 35 allows control over operation of the rotary actuator 16 for reorienting a roll 34, 36, as described.

Either a three inch or six inch roll 34, 36 may be accepted on a respective diameter 38, 40 of the stepped diameter holder 22 which is mounted on the lower end 21 of the arm 20 by means of a cap plate 42 secured to a hanger plate 44 with cap screws 46. The hanger plate 44 is welded to the lower end of the arm 20.

A push off air cylinder 48 is mounted to the hanger plate 44 below the stepped holder 22. A pusher plate 50 is fixed to the output rod of the push off cylinder 48 located to engage the side of either a three inch or six inch roll 36, 34 as shown.

A safety limit switch 52 may also be provided, mounted to the pusher plate 50 and activated when a roll 34 or 36 is fully seated on the stepped diameter 38, 40 of holder 22.

Referring to FIG. 3, the stepped holder 22 comprises an aluminum housing 54 having the stepped diameters 38, 40 formed thereon which each have four slots 54, 56 which receive sets of gripper elements 58, 60. A ball locking assembly 96 projects from the smaller diameter 38 of the holder 22. An actuator rod 62 is adapted to be axially driven by an air cylinder 64, the actuator rod 62 connected to hubs 66, 68 to be moved in or out when the air cylinder 64 is activated in either direction. In one direction of motion axial of the rod 62, the serrated gripper surfaces 70, 72 move out to engage the roll core. When the rod 62 is axially stroked in the other direction, the sets of gripper elements 58, 60 are released and four locking balls 74 each receive in a pocket 76 included in the ball locking assembly 96 are forced out by a step 79 in the rod 62 during docking. A retainer collar 78 has an inner edge which prevents the balls 74 from escaping.

Figure 4:
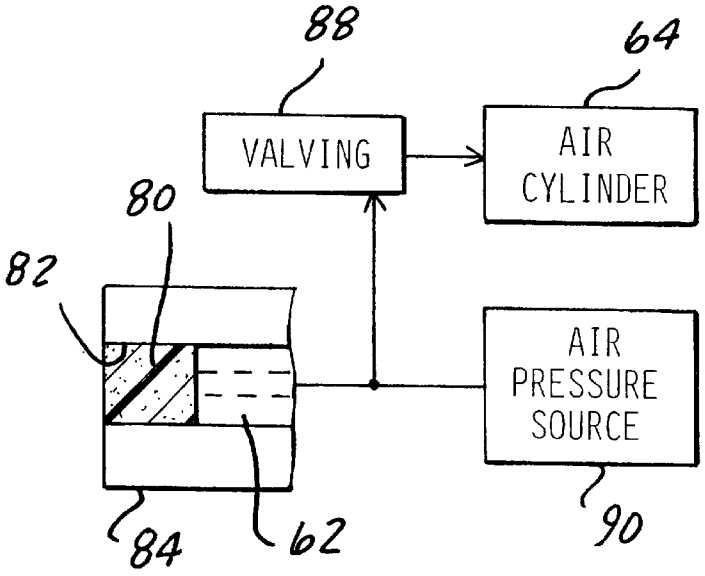
FIG. 4 is a schematic diagram of the pneumatic control for operating the docking feature.

A closed cell foam plastic or rubber compressible insert 80 (FIGS. 1, 4) is positioned within a bore 82 of receptacle 84 fixed to a spindle 92 to block a hole 86 (FIG. 3) in the end of the rod 62 connected to an air pressure source 90. The resulting back pressure increase generates a pressure signal to valving 88 to confirm that the end of the stepped holder 22 is fully inserted in the receptacle 84 attached to the end of a roll receiving spindle 92, and allows the pusher cylinder 48 to be operated as the "docking" has been completed. That is, the balls 74 have been moved radially out to engage the bore 82 in the receptacle 84.

The gripper elements 58 and 60 are released during the same stroking of the rod 62 to allow a roll 34 or 36 to be pushed off.

It will be appreciated by those skilled in the art that various automatic sequencing can be provided for, i.e., after the rod 62 advances into the receptacle 84 and bottoms on the insert 80, the cylinder 64 is automatically caused to be operated so that the rod 62 is stroked to lock the balls 74 in position and release the gripping elements 58, 60. Or, manual operation of the valves 24 or 26 can be employed. A mode control dial 94 can allow automatic or manual sequencing. Thus, in use, the operator brings the stepped holder 22 over a vertically disposed roll and inserts the same.

When the limit switch 52 is tripped by a roll 34 or 36 being fully seated on a stepped diameter 38 or 40, thereinto, the gripper elements 58 and 60 are operated to grip the roll core. The locking balls 74 are retracted at this time.

A dial 35 is operated to rotate the roll to a horizontal position after raising the roll 34 or 36 above the floor or a stack of rolls by operation of the hoist 14.

The roll 34 or 36 is brought to the spindle 92, and the locking ball assembly 96 is inserted in the bore 82 of the receptacle 84. The balls 74 are moved outwardly to lock to the receptacle 84 to achieve "docking" between the spindle 92 and the holder 22, after the rod 62 is fully inserted (detected by the rod end contacting the insert 80) and the gripper elements 58, 60 are fully released. The pusher cylinder 48 is then operated to push a roll 34 or 36 onto the spindle 92.

Referring to FIG. 5, a roll 36 lying down with its core axis perpendicular can be picked up by vertically orienting the holder 22, inserting the diameter 38 in the core 98 and operating the cylinder 64 to grip the core 98. The roll 36 is lifted by the hoist 14 and actuator 16 operated to swing the roll 36 up with its core axis horizontal. The apparatus 10 is turned on a support cable 100 and the holder 22 aligned with the spindle 92; using the traveling hoist 14, the ball locking assembly 96 is fully inserted in the receptacle 84 as shown in FIG. 1, and the procedure described above is thereafter carried out.

What is claimed is:

1. Apparatus for handling rolls of material having a hollow core comprising:

a support structure adapted to be lifted by a hoist;

a rotary actuator having a selectively oscillated output shaft extending at an angle from the vertical;

an arm having two portions, an upper portion connected to said rotary actuator shaft and extending therefrom, and a lower portion angled with respect to said upper portion, said lower portion flipped between a vertical position and a horizontal position by oscillation of said actuator output shaft;

a stepped diameter holder mounted on said lower arm portion to project therefrom, said stepped holder having large and small diameters adapted to receive large or small diameter roll cores respectively;

sets of gripping elements carried by said large and small diameters respectively; an actuator rod operatively associated with said gripper elements to be moved in and out to grip or release a roll core disposed on a respective diameter when said rod is moved axially; an actuator cylinder coupled to said actuator rod for powering said axial movement of said actuator rod.

2. The apparatus according to claim 1 further including a receptacle mounted to a spindle onto which a roll is able to be slidably received, said receptacle having an internal bore of a smaller diameter than said spindle;

said stepped holder further including a ball locking assembly of a smaller diameter than said holder small diameter and projecting therefrom, said ball locking assembly including a set of balls moved radially out upon continued movement of said actuator rod axially in a direction causing inward releasing movement of said gripping elements, said balls engaging said receptacle bore walls when said ball assembly is inserted therein and said balls are moved radially outwardly.

3. The apparatus according to claim 2 further including an insert of compressive material in said receptacle bore engaging an end of said rod after being fully inserted therein, said rod having an air passage blocked by contact with said insert, said blockage comprising a pneumatic signal enabling reversing of said rod movement to cause locking movement of said balls and releasing movement of said gripping elements.

4. Apparatus for handling rolls of material having a hollow core, comprising:

a stepped holder capable of receiving either of two sizes of rolls on respective different diameters of said holder, said stepped holder mounted on a supporting structure;

an actuator rod extending axially within said stepped holder and sets of gripper elements recessed into each holder portion interengaged with said actuator rod to cause outward gripping of each gripper element upon axial movement of said actuator rod in one direction, and inward releasing movement of each gripper set upon axial movement of said actuator rod in an opposite direction;

an actuator cylinder coupled to said actuator rod to power said axial movement thereof;

a ball locking assembly projecting axially from a smaller diameter of said stepped holder including a set of balls movable radially outwardly by movement of said actuator rod in said opposite direction, said balls moved radially outward by movement of said actuator rod in a direction causing release of s aid gripper elements.

5. Apparatus for handling rolls of material as set forth in claim 4 wherein said rolls are able to be placed on a spindle by said apparatus, said spindle having a receptacle fixed on a projecting end thereof and having a bore sized to receive said ball locking assembly with said set of balls moved radially inward but able to be gripped to produce docking by movement of said actuator rod in said direction releasing said gripper elements.

6. Apparatus for handling rolls of material as set forth in claim 5 wherein said actuator rod has a hole in an end passing within said ball locking assembly supplied with air pressure, and further including a compressible insert in said receptacle bore contacted by said actuator rod end upon axial movement in a direction opposite said direction releasing said gripper elements, and control means enabling reversal of movement of said actuator rod after said hole is blocked to thereafter enable said locking of said ball locking assembly in said receptacle and release of said gripper elements, to enable push off of said roll from said stepped holder onto said spindle.

7. Apparatus for handling rolls of material as set forth in claim 6 further including a pusher cylinder and plate operable to power said push off of said roll from said stepped holder and onto said spindle.

* * * * *

UNITED STATES PATENT AND TRADEMARK OFFICE

CERTIFICATE OF CORRECTION

PATENT NO. : 6,354,644 B1
DATED : March 12, 2002
INVENTOR(S) : James Zaguroli Jr. et al.

It is certified that error appears in the above-identified patent and that said Letters Patent is hereby corrected as shown below:

Column 5,
Line 14, after "outward gripping" insert -- movement --.

Signed and Sealed this

Seventh Day of January, 2003

JAMES E. ROGAN
*Director of the United States Patent and Trademark Office*